US009869216B2

(12) United States Patent
Alger, II et al.

(10) Patent No.: US 9,869,216 B2
(45) Date of Patent: Jan. 16, 2018

(54) SYSTEM AND METHOD TO DECREASE WARMUP TIME OF COOLANT AND ENGINE OIL IN ENGINE EQUIPPED WITH COOLED EGR

(71) Applicant: Southwest Research Institute, San Antonio, TX (US)

(72) Inventors: Terrence F. Alger, II, San Antonio, TX (US); Christopher J. Chadwell, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 280 days.

(21) Appl. No.: 14/611,449

(22) Filed: Feb. 2, 2015

(65) Prior Publication Data

US 2016/0222868 A1 Aug. 4, 2016

(51) Int. Cl.

| | |
|---|---|
| ***F01M 5/02*** | (2006.01) |
| ***F01P 3/20*** | (2006.01) |
| ***F01P 11/08*** | (2006.01) |
| ***F02M 26/28*** | (2016.01) |
| ***F01M 5/00*** | (2006.01) |
| *F02B 47/08* | (2006.01) |

(52) U.S. Cl.

CPC ..... *F01M 5/021* (2013.01); *F01M 5/00* (2013.01); *F01P 3/20* (2013.01); *F01P 11/08* (2013.01); *F02M 26/28* (2016.02); *F01P 2060/04* (2013.01); *F01P 2060/16* (2013.01); *F02B 47/08* (2013.01)

(58) Field of Classification Search

CPC .... F02M 25/07; F02M 25/0712; F02M 26/28; F02B 47/08; F02B 43/08; F01P 7/06; F01P 11/08; F01P 2060/04; F01P 2060/16; F01M 5/021; F01M 5/00

USPC ..... 123/41.01, 41.33, 41.08, 41.31, 685, 123/568.12

See application file for complete search history.

(56) References Cited

U.S. PATENT DOCUMENTS

| | | | | |
|---|---|---|---|---|
| 2006/0157002 | A1* | 7/2006 | Pfeffinger | F01P 7/162 123/41.29 |
| 2010/0001085 | A1* | 1/2010 | Obidi | F01P 7/165 236/93 R |
| 2014/0041643 | A1* | 2/2014 | Han | F02B 47/08 123/568.12 |

* cited by examiner

*Primary Examiner* — Syed O Hasan

(74) *Attorney, Agent, or Firm* — Livingston Law Firm

(57) ABSTRACT

A cooling system and method of using a cooling system for an engine equipped with an exhaust gas recirculation (EGR) system. A pump provides pressure for circulating liquid through the cooling system. The cooling system has two loops: an engine cooling loop and an EGR cooling loop. The engine cooling loop cools the engine in a conventional manner. The EGR cooling loop goes first to an EGR cooler and next to an oil cooler. The heat exchange at the EGR cooler results in warmed coolant being delivered to the oil cooler, where it warms engine oil. Warm-up time for engine oil is thereby decreased.

10 Claims, 4 Drawing Sheets

SYSTEM AND METHOD TO DECREASE WARMUP TIME OF COOLANT AND ENGINE OIL IN ENGINE EQUIPPED WITH COOLED EGR

TECHNICAL FIELD OF THE INVENTION

This invention relates to automotive cooling systems, and more particularly to such systems in automotive vehicles equipped with an exhaust gas recirculation loop.

BACKGROUND OF THE INVENTION

Internal combustion engines are often cooled by circulating a liquid, typically water mixed with coolant, through the engine block. The liquid circulates in small passages, undergoing heat exchange with the hot engine. The heated liquid then passes through a radiator, which transfers heat from the liquid inside the radiator pipes to air outside the radiator, thereby cooling the liquid. The liquid is then re-circulated to the engine. A water pump assists in circulating the liquid, and a fan assists the radiator's heat exchange by blowing air upon the radiator's surfaces.

In automotive vehicles, the above-described engine radiator is typically mounted in a position where it receives airflow from the forward movement of the vehicle, such as behind a front grill. This engine radiator is sometimes referred to as the "main" radiator because the vehicle's cooling system may also include additional, usually smaller, radiators.

For example, additional radiators are sometimes used to cool automatic transmission fluids, air conditioner refrigerant, intake air, motor oil or power steering fluid. For cooling motor oil, a small radiator used to cool the engine oil is referred to as an "oil cooler".

For engines equipped with exhaust gas recirculation (EGR), another type of cooler that may be part of the vehicle's cooling system is an EGR cooler. An EGR cooler reduces exhaust gas temperatures prior to recirculating the exhaust back to the engine's intake system. Typically, the EGR cooler uses liquid coolant and is in fluid communication with the rest of the vehicle's overall cooling system.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a method and cooling system for reducing the warm-up time for coolant in an automotive vehicle equipped with an internal combustion engine and EGR. As explained below, the vehicle's "cooling" system is referred to as such even though it may be used to add heat to, as well as remove heat from, various parts of the vehicle system. For example, the cooling system may be used to redistribute heat from the engine to heat the passenger compartment of the vehicle. As another example, the cooling system may redistribute heat from an EGR cooler to an oil cooler to heat engine oil.

Figure 1:
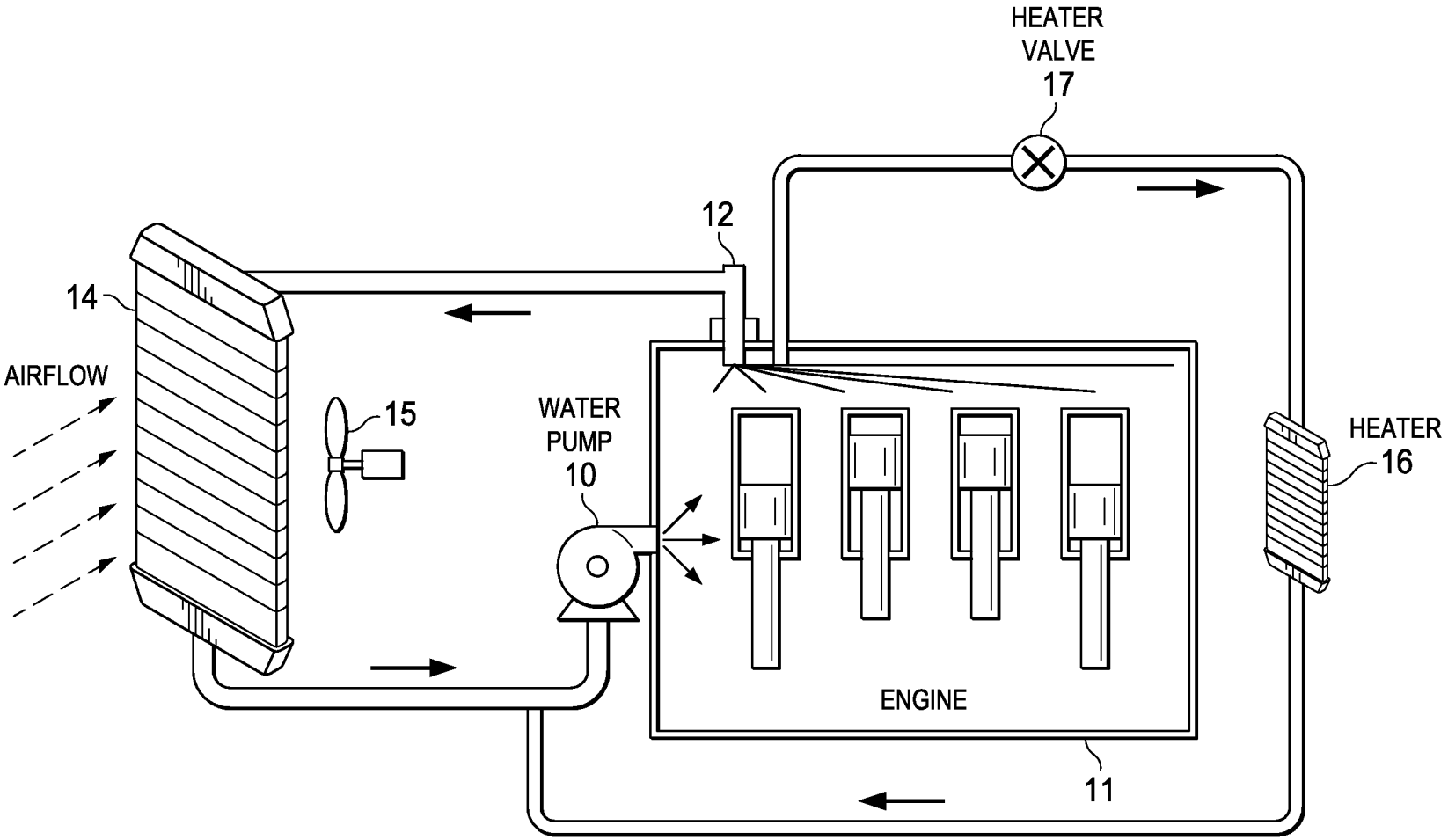
FIG. 1 illustrates the basic components of a conventional automotive cooling system.

FIG. 1 illustrates basic components of a conventional automotive cooling system. The cooling system is a liquid cooling system, in which liquid (water with a coolant additive) is circulated to various parts of the automobile system. By convention and for purposes of this description, the cooling liquid is referred to herein as "coolant" regardless of the type of liquid or additives.

As stated in the Background, coolant is circulated throughout the cooling system using a water pump 10. In FIG. 1, the directed arrows represent the flow of coolant through various coolant lines.

Pump 10 delivers the coolant to the engine 11, which has channels running through its engine block and cylinder head. The coolant circulates throughout the engine. Next, the now-heated coolant flows, via a thermostat 12, to the radiator 14, where an airflow heat exchange occurs, assisted by fan 15. This cools the coolant so that it can be recirculated back to the engine.

Heated coolant from the engine 11 may also be delivered to a passenger compartment heater 16. This small heater 16 is a radiator-type heat exchanger, and has an associated blower fan. The heater 16 and its fan warm the passenger compartment's interior, as controlled by valve 17. Like the main radiator 14, the heater 16 removes heat from the engine, but heater 16 makes use of this heat for heating purposes. Coolant from the heater 16 flows back to the pump 10.

Figure 2:
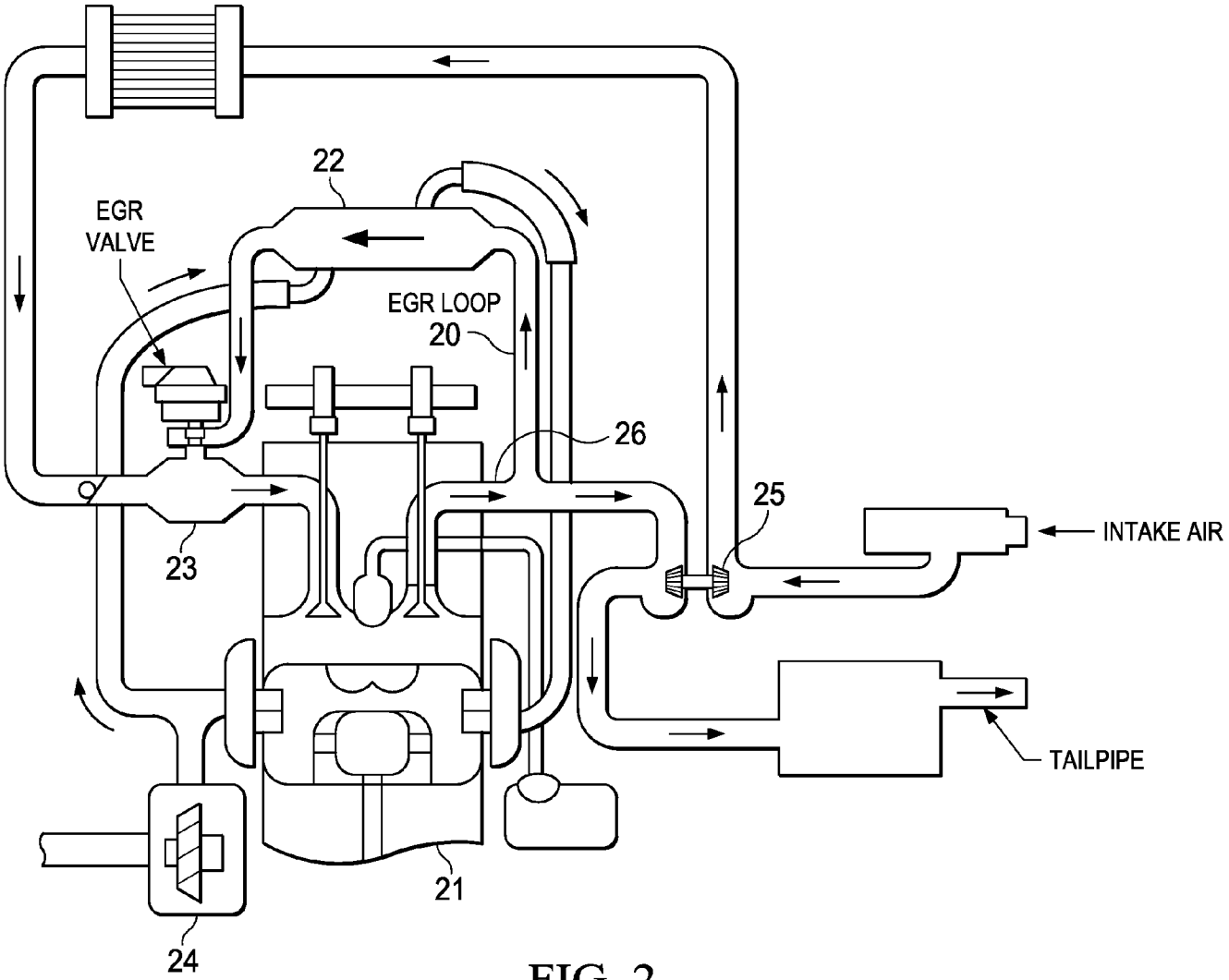
FIG. 2 illustrates an engine equipped with a conventional exhaust gas recirculation (EGR) loop.

FIG. 2 illustrates an engine 21 equipped with a conventional exhaust gas recirculation (EGR) loop 20. Engine 21 is assumed to be suitable for use with an automotive type vehicle. The directed arrows indicate the separate flow paths of the intake/exhaust of the engine as well as coolant through the cooling system.

With regard to the engine intake/exhaust path, intake air is charged by the compressor portion of turbocharger 25, and is mixed with recirculated exhaust upstream of the intake manifold 23. Exhaust from engine 21 exits via the exhaust manifold 26, with a portion of the exhaust being recirculated via EGR loop 20. The rest of the exhaust is used for operation of the turbine portion of turbocharger 25 and exits via the tailpipe.

With regard to the coolant path, a water pump 24 operates in a manner similar to that of water pump 10 of FIG. 1. It is assumed that the engine 21 is equipped with other basic cooling system components illustrated in FIG. 1, such as a radiator and fan. However, for simplicity of illustration, only those cooling system components relevant to EGR cooling are shown.

EGR cooler 22 is a liquid-air heat exchanger, and uses coolant from the cooling system to cool the recirculated exhaust. EGR cooler 22 cools the recirculated exhaust prior to the exhaust entering the intake manifold 23.

As illustrated, in this conventional EGR system, the coolant flow path from pump 24 includes an EGR coolant path to EGR cooler 22. This EGR coolant path returns coolant back to pump 24, in this case via the engine coolant path.

Figure 3:
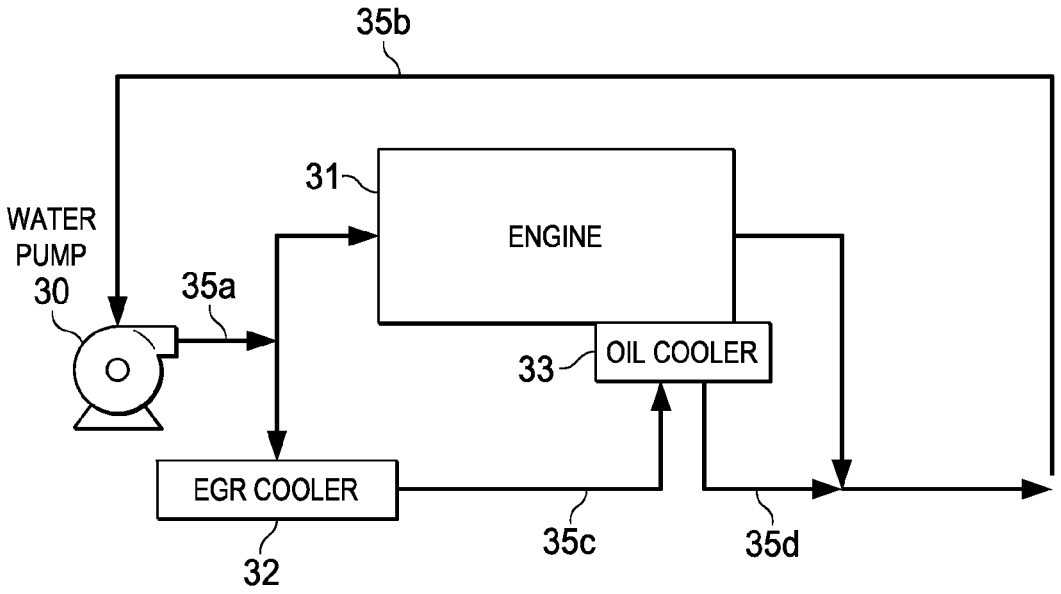
FIG. 3 illustrates an improved coolant system for an EGR equipped engine, such as the engine of FIG. 2.

FIG. 3 illustrates an improved coolant system for an EGR equipped engine, such as the engine of FIG. 2. The directed arrows paths represent coolant flow lines in fluid communication with various parts of the vehicle system.

The coolant system of FIG. 3 provides a method of orienting the cooling circuit of an EGR cooler 32 and an oil cooler 33. Although not explicitly shown in FIG. 3, the coolant path will typically also have the basic elements of a coolant system, including a radiator and fan, such as illustrated in FIG. 1.

Water pump 30 pumps coolant through a pump output path 35*a*, which divides into an engine coolant loop 35*b* and an EGR coolant loop 35*c*. Thus, water pump 30 may deliver coolant simultaneously to both the engine 31 and to the EGR cooler 32. The heat exchange process facilitated by the coolant for the engine 31 and the EGR cooler 32 is like that described above in connection with FIGS. 1 and 2.

From engine 31, the coolant flows back to the water pump 30 via the engine coolant loop 35*b*. From EGR cooler 32, coolant flows to an oil cooler 33, whose coolant input is in fluid communication with the EGR coolant loop 35*c*. From oil cooler 33, the coolant flows through an oil cooler output path 35*d* to directly join the engine coolant loop 35*b*.

Thus, coolant flows through the EGR cooler 32 and then directly to the oil cooler 33. Oil cooler 33 is closely coupled with engine 31. Oil cooler 33 may be any type of oil-to-liquid heat exchanger. Oil circulating within oil cooler 33 is warmed (or cooled) by the coolant.

As explained below, the placement of oil cooler 33 relative to EGR cooler 32 is such that coolant warmed by EGR cooler 32 will provide heat to warm the oil in oil cooler 33. The more proximate oil cooler 33 is to EGR cooler 32, the more heat will be available from the coolant that is warmed by EGR cooler 32.

An object of this configuration is to decrease the warm up time of the engine 31. When the engine is cold, heat rejected from the EGR cooler 32 is used to heat the rest of the engine. The coolant from the EGR cooler 32 will be warmed. In particular, the warmer coolant will heat the engine oil, using the heat exchange from the coolant to the engine oil as provided by oil cooler 33.

For conventional engines, on the Federal Test Procedure (FTP), the engine oil often takes a considerable time to warm up. Cold engine oil contributes to a nearly 15% difference between the fuel economy on the first bag of the FTP and the 3rd bag of the FTP.

It is recognized that at fully warm engine conditions, the temperature gain of the coolant flowing through EGR cooler 32 is not significant enough to detract from the ability to cool the oil in oil cooler 33.

At some low load conditions, the use of warm coolant coming from the EGR cooler 32 will help keep the oil in oil cooler 33 near optimal temperature. In comparison, in conventional engines, at low loads, the oil can cool below optimum temperatures.

Figure 4:
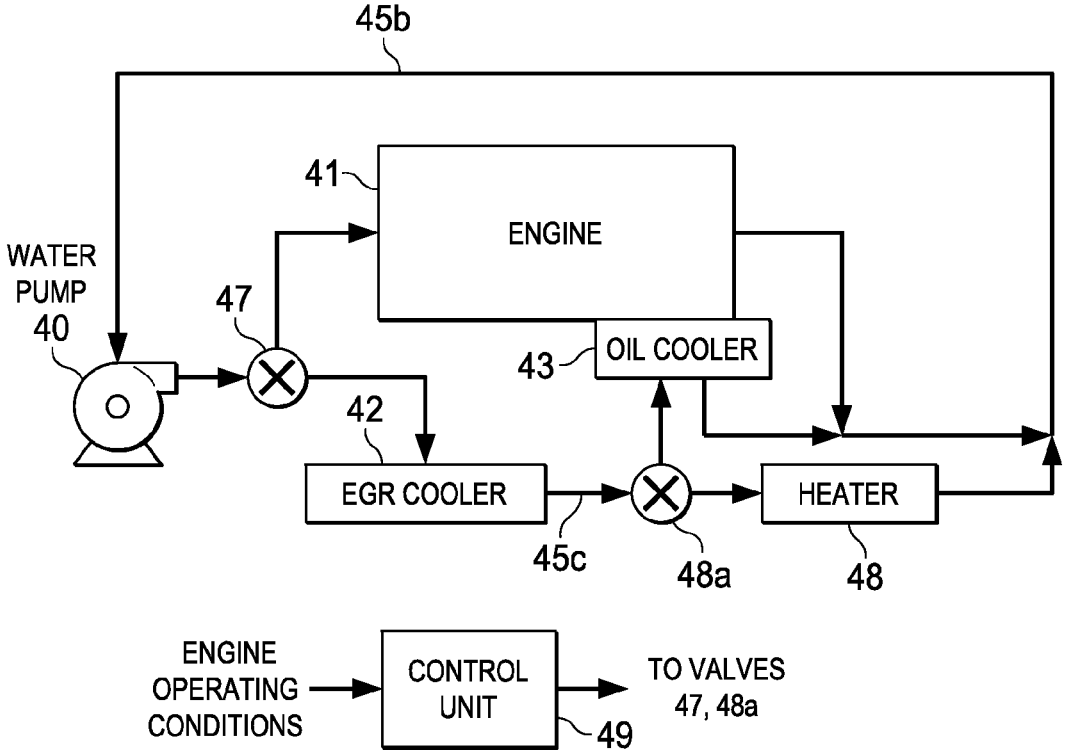
FIG. 4 illustrates the coolant system of FIG. 3 with various enhancements.

FIG. 4 illustrates the coolant system of FIG. 3, but with various enhancements that may be used together or separately.

A first modification is a valve 47, which may be used to control the flow of coolant from pump 40 to the engine 41 and to EGR cooler 42. Valve 41 can be used to send coolant to only the coolant loop 45*c* for EGR cooler 42 and oil cooler 43, or to only the coolant loop 45*b* for engine 41, or to both coolant paths 45*b* and 45*c*. Valve 47 can be a modulating type valve, such that the relative proportions of coolant to the coolant paths can be continuously adjusted.

For example, valve 47 can be used to turn off coolant to the engine 41 upon cold start. A control unit 49 can be programmed to receive data representing cold start engine conditions, and to generate a control signal to valve 47. When the engine is cold, it may be desirable to deliver all or a higher proportion of the coolant from the pump 40 to the EGR coolant loop 45*c*. Cold start conditions may be represented with various data delivered to control unit 49, such as key on data or temperature data.

Another modification illustrated in FIG. 4 is that the EGR coolant loop 45*c* can be connected to a passenger compartment heater 48. This coolant path will allow a decrease in the waiting time needed for warm air when requested by the vehicle's driver. The output path from heater 48 can be connected to the engine coolant loop 45*b*. A valve 48*a* may be used to control the relative proportions of coolant that flows to oil cooler 43 and heater 48.

A control unit 49 has appropriate processing hardware and software to control valves 47 and 48*a* in the manner described above. Control unit 49 may be part of a larger engine control unit or EGR control unit.

Figure 5:
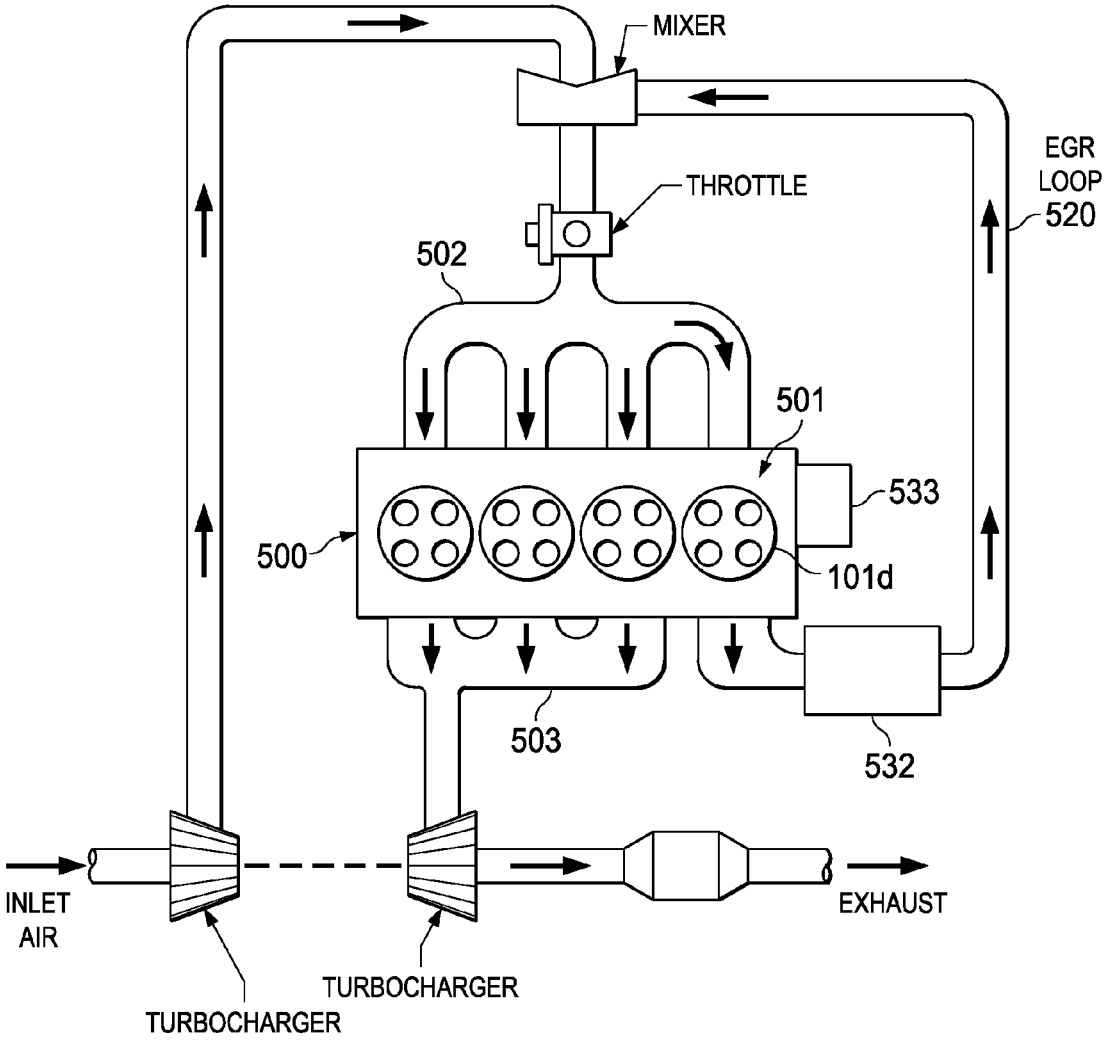
FIG. 5 illustrates an engine equipped with dedicated EGR, also suitable for use with the cooling system of FIG. 3.

FIG. 5 illustrates an engine system having dedicated EGR. Referring to both FIGS. 3 and 5, it can be seen that the coolant system of FIG. 3 can be easily installed into the system of FIG. 5. In other words, the arrowed coolant paths of FIG. 3 can be easily added to the system of FIG. 5.

In this system, EGR cooler 532 will provide heat almost immediately upon start-up. As described above, this heat can be used to heat oil cooler 533 and/or a passenger compartment heater such as heater 48 of FIG. 4.

In the dedicated EGR system of FIG. 5, the internal combustion engine 500 has four cylinders 501. One of the cylinders is a dedicated EGR cylinder, and is identified as cylinder 501*d*. The dedicated EGR cylinder 501*d* may be operated at any desired air-fuel ratio. All of its exhaust is recirculated back to the intake manifold 502. In the embodiment of FIG. 5, the other three cylinders 501 (referred to herein as the "main" or "non dedicated" cylinders) are operated at a stoichiometric air-fuel ratio.

In the example of this description, the EGR line 520 joins the intake line downstream the turbocharger's compressor. A mixer mixes the fresh air intake with the EGR gas, and a throttle controls the amount of intake (fresh air and EGR) into the intake manifold 502.

In other embodiments, there may be a different number of engine cylinders 501, and/or there may be more than one dedicated EGR cylinder 501*d*. In general, in a dedicated EGR engine configuration, the exhaust of a sub-group of cylinders is routed back to the intake of all the cylinders, thereby providing EGR for all cylinders. In some embodiments, the EGR may be routed to only the main cylinders.

After entering the cylinders 501, the fresh-air/EGR mixture is ignited and combusts. After combustion, exhaust gas from each cylinder 501 flows through its exhaust port and into exhaust manifold 503. After the turbine, exhaust gas flows to an aftertreatment device, to be treated before exiting to the atmosphere.

If a dedicated EGR cylinder is run rich of stoichiometric A/F ratio, a significant amount of hydrogen (H2) and carbon monoxide (CO) may be formed. In many engine control strategies, this enhanced EGR is used to increase EGR tolerance by increasing burn rates, increasing the dilution limits of the mixture and reducing quench distances. In addition, the engine may perform better at knock limited conditions, such as improving low speed peak torque results, due to increased EGR tolerance and the knock resistance provided by hydrogen (H2) and carbon monoxide (CO).

What is claimed is:

1. A cooling system for an engine equipped with an exhaust gas recirculation (EGR) system, comprising: a pump for providing pressure for circulating liquid through the cooling system; an engine cooling loop from the pump, the engine cooling loop configured to deliver a portion of liquid from the pump to the engine and to return the liquid from the engine to the pump; an EGR cooling loop from the pump; a valve connected directly downstream of the pump, operable to divide all or part of the output of the pump between the engine cooling loop and the EGR cooling loop; an EGR cooler; an oil cooler; wherein the EGR cooling loop is configured to deliver a portion of liquid from the pump to the EGR cooler and to deliver the liquid from the EGR cooler to the oil cooler; wherein the EGR cooler is operable to cool recirculated exhaust and to warm the coolant by means of heat exchange; wherein the oil cooler is located sufficiently proximate the EGR cooler such that the oil cooler is operable to warm engine lubrication oil within the oil cooler by means of heat exchange with coolant delivered from the EGR cooler; and wherein the EGR cooling loop is further configured to deliver coolant from the oil cooler to a return portion of the engine cooling loop.

2. The system of claim 1, wherein the EGR system is a dedicated EGR system.

3. The system of claim 1, further comprising the valve operable to control the relative proportions of liquid delivered to the engine cooling loop and to the EGR cooling loop.

4. The system of claim 3, further comprising a control unit programmed to receive data representing cold engine conditions, and to actuate the valve depending on the engine conditions.

5. The system of claim 1, further comprising a passenger compartment heater connected to the EGR cooling loop, such that coolant from the EGR cooler is delivered to the oil cooler and/or the passenger compartment heater.

6. A method of using an exhaust gas recirculation (EGR) system of an internal combustion engine for heating engine oil during cold start engine conditions, the engine further having a cooling system with a pump for circulating liquid and an engine cooling loop, comprising: connecting an EGR cooling loop to an output line of the pump, the EGR cooling loop configured to deliver a portion of liquid from the pump to an EGR cooler and to deliver the liquid from the EGR cooler to an oil cooler; wherein the connecting step is performed by means of a valve connected directly downstream of the pump, operable to divide all or part of the output of the pump between the engine cooling loop and the EGR cooling loop; during cold start conditions, operating the valve to direct all or most of the coolant to the EGR cooling loop; wherein the EGR cooler is operable to warm the coolant by means of heat exchange with exhaust from the engine; wherein the oil cooler is operable to warm engine lubrication oil within the oil cooler by means of heat exchange with coolant delivered to the oil cooler from the EGR cooler; and wherein the EGR cooling loop is further configured to deliver coolant from the oil cooler to a return portion of the engine cooling loop.

7. The method of claim 6, wherein the EGR system is a dedicated EGR system.

8. The method of claim 6, further comprising using the valve to control the relative proportions of liquid delivered to the engine cooling loop and to the EGR cooling loop.

9. The method of claim 8, further comprising a using a control unit programmed to receive data representing cold engine conditions and to actuate the valve depending on the engine conditions.

10. The method of claim 6, further comprising connecting a passenger compartment heater to the EGR cooling loop, such that coolant from the EGR cooler is delivered to the oil cooler and/or the passenger compartment heater.

* * * * *